US012325993B2

(12) United States Patent
Eyme

(10) Patent No.: US 12,325,993 B2
(45) **Date of Patent: *Jun. 10, 2025**

(54) TRACK SYSTEM FOR DOUBLE BUTT JOINT GLASS T-CONNECTIONS

(71) Applicant: Florian Eyme, Columbia, MD (US)

(72) Inventor: Florian Eyme, Columbia, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/519,401

(22) Filed: Nov. 27, 2023

(65) Prior Publication Data

US 2024/0084589 A1 Mar. 14, 2024

Related U.S. Application Data

(63) Continuation of application No. 16/603,403, filed as application No. PCT/IB2018/000930 on Apr. 9, 2018, now Pat. No. 11,933,044.

(60) Provisional application No. 62/483,203, filed on Apr. 7, 2017.

(51) Int. Cl.
*E04B 2/82* (2006.01)
*E04B 2/74* (2006.01)

(52) U.S. Cl.
CPC ..... *E04B 2/82* (2013.01); *E04B 2/7401* (2013.01)

(58) Field of Classification Search
CPC ..... E04B 2/82; E04B 2/7401; E04B 2/745
USPC ..... 52/208
See application file for complete search history.

(56) References Cited

U.S. PATENT DOCUMENTS 3,292,328 A * 12/1966 Darling ..... E05C 19/16 52/471
3,293,813 A * 12/1966 Emmons ..... E04B 2/7854 52/456
3,381,438 A * 5/1968 Bohnsack ..... E04B 2/78 52/584.1
3,537,217 A * 11/1970 Lickliter ..... E04B 2/825 52/762
3,721,057 A * 3/1973 Lieber ..... E04B 2/78 52/241
4,103,463 A * 8/1978 Dixon ..... E05D 15/0613 52/143
4,361,994 A * 12/1982 Carver ..... E06B 3/5821 D25/121
4,574,547 A * 3/1986 Menchetti ..... E06B 3/68 52/241
6,047,508 A * 4/2000 Goodman ..... E04B 2/745 52/584.1
6,122,871 A * 9/2000 Russell ..... E04B 2/82 52/241
6,141,925 A * 11/2000 Halvorson, Jr. ..... E04B 2/7455 52/204.53
6,158,179 A * 12/2000 Ackerly ..... E04B 2/745 52/36.5
8,646,231 B2 * 2/2014 Eyme ..... E04B 2/7427 52/282.4
9,506,246 B2 * 11/2016 Joseph ..... E04B 2/828

(Continued)

*Primary Examiner* — James M Ference
(74) *Attorney, Agent, or Firm* — Steven Scott Lloyd

(57) ABSTRACT

A system and apparatus for construction interior glass partitions in a double butt joint glass T-connection using a generally U-shaped horizontal track profile pre-scored lengthwise with a frangible line to provide for portions of the side walls to be easily cut and removed for insertion of a ninety-degree return track element. The system and method make T-connections of double glass partitions economical to fabricate and install.

8 Claims, 8 Drawing Sheets

(56) References Cited

U.S. PATENT DOCUMENTS

| | | | | |
|---|---|---|---|---|
| 9,803,361 | B2 * | 10/2017 | Von Hoyningen Huene | E04B 2/7457 |
| 9,920,522 | B2 * | 3/2018 | Staten | E04B 2/7809 |
| 9,982,431 | B2 * | 5/2018 | Del Missier | E04B 2/7448 |
| 10,247,874 | B2 * | 4/2019 | Eyme | E04B 2/7401 |
| 2002/0189172 | A1 * | 12/2002 | Kaeser | E04B 2/82 52/64 |
| 2003/0089057 | A1 * | 5/2003 | Wiechecki | E04B 2/7427 52/238.1 |
| 2007/0245654 | A1 * | 10/2007 | Baccarini | E04B 2/7457 52/255 |
| 2012/0023855 | A1 * | 2/2012 | Eyme | E04B 2/7427 52/582.1 |
| 2014/0338285 | A1 * | 11/2014 | Eyme | E05D 15/066 52/745.15 |
| 2015/0047280 | A1 * | 2/2015 | Staten | E04B 2/7455 52/741.1 |
| 2015/0354212 | A1 * | 12/2015 | Von Hoyningen Huene | E04B 2/7457 52/745.1 |
| 2015/0376899 | A1 * | 12/2015 | Joseph | E06B 3/6621 52/241 |
| 2015/0376900 | A1 * | 12/2015 | Joseph | E04B 2/7401 52/241 |
| 2016/0356039 | A1 * | 12/2016 | Del Missier | E04B 2/7401 |
| 2018/0217319 | A1 * | 8/2018 | Eyme | E04B 2/7401 |
| 2021/0087813 | A1 * | 3/2021 | Eyme | E04B 2/7401 |
| 2024/0084589 | A1 * | 3/2024 | Eyme | E04B 2/82 |

* cited by examiner

100

TRACK SYSTEM FOR DOUBLE BUTT JOINT GLASS T-CONNECTIONS

CROSS REFERENCE TO RELATED APPLICATION

This application is a continuation of U.S. patent application Ser. No. 16/603,403, filed Oct. 7, 2019, which is a national entry of PCT App. Ser. No. PCT/IB2018/000930, filed Apr. 9, 2018, which in turn derives priority from U.S. Provisional Patent Applicant Ser. No. 62/483,203 filed Apr. 7, 2017, the contents of which, in each case, are hereby incorporated by reference in their entirety.

BACKGROUND OF THE INVENTION

1. Field of the Invention

The present invention relates generally to glass partitioning systems for interior spaces and more specifically to an adaptable partitioning system capable of supporting heavy and operative panels.

2. Description of the Background

Division of interior spaces in office buildings, convention halls and the like is a common need, and glass partitioning systems such as shown in FIG. 1 are gaining popularity due to their stylish modern appearance. The glass panels are supported within formwork comprising an upper U-shaped channel and a lower U-shaped channel. This formwork is constructed of straight segments of "track" formed of extruded aluminum and attached together at butt joints to construct angles.

Such lightweight, extruded aluminum frame systems must be carefully designed to support heavy panels, panes of tempered glass, heavy doors, or other partitioning components that impose dynamic loading conditions. This is especially difficult where heavy glass panes are joined together, such as at T-joints as shown in FIG. 1 or where sliding doors are mounted on the top track. A T-joint as shown in FIG. 1 generally comprises a front glass partition and a dividing glass wall. The front glass partition can utilize single or double glass while the dividing wall is typically always double-glass. Thus, for example, in the instance where the glass partitioning system utilizes a double glass front, the formwork must join a double-return track to a main track at a T-intersection, e.g., a "double butt joint glass T-connection." These double butt joint glass T-connections are difficult to fabricate and install, and prone to failure when done improperly.

What is needed is a track system and method of installation thereof capable of constructing a reliable double butt joint glass T-connection easily and quickly.

SUMMARY OF THE INVENTION

It is, therefore, an object of the present invention to provide a system and method of partitioning interior spaces by a partitioning system capable of supporting heavy operative glass panels in a double butt joint glass T-connection.

It is another object to provide a double butt joint glass T-connection as above that is easy and economical to fabricate and install.

The system utilizes a horizontal track profile preferably formed of extruded aluminum and having a horizontal base portion extending upward at distal rails to form an open U-shaped element. Within the U-shape is a central longitudinal channel flanked on either side by channels formed between a protruding trim stop and protruding channel side wall. The track element includes a longitudinal pre-scored frangible line formed lengthwise to provide for portions of the side walls to be easily cut and removed for insertion of a ninety-degree return track element in a double butt joint glass T-connection that is easy and economical to fabricate and install.

According to the inventive system, a cooperative panel retainer is secured within the channel of the open U-shaped base, and a cover snap fits into the panel retainer.

During installation, the bottom track element is aligned with the return track element in a T-junction, the return track is used to mark and cut the main track, and the cut portion of the main track side wall is broken off along the frangible pre-scored line to create a window. The same is done for the upper track, and the glass panes are installed to complete a double butt joint glass T-connection that is easy and economical to fabricate and install.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is a track system 2 for double-butt-joint T-connections of glass partitions that provides an elegant aesthetic yet is economical to fabricate, easy to install, and capable of reliable support of heavy and operative glass panels while accommodating variation in floor surface level.

For purposes of definition, a "T-joint" or "T-connection" is herein defined as any substantially right-intersection of two glass partitions.

A double-butt-joint T-connection is herein defined as any T-joint in which a double glass return intersects either a single glass front, or a double glass front. Thus, for purposes of the invention the front glass partition can utilize single or double glass while the dividing wall (or return) is typically always double-glass.

Figure 1:
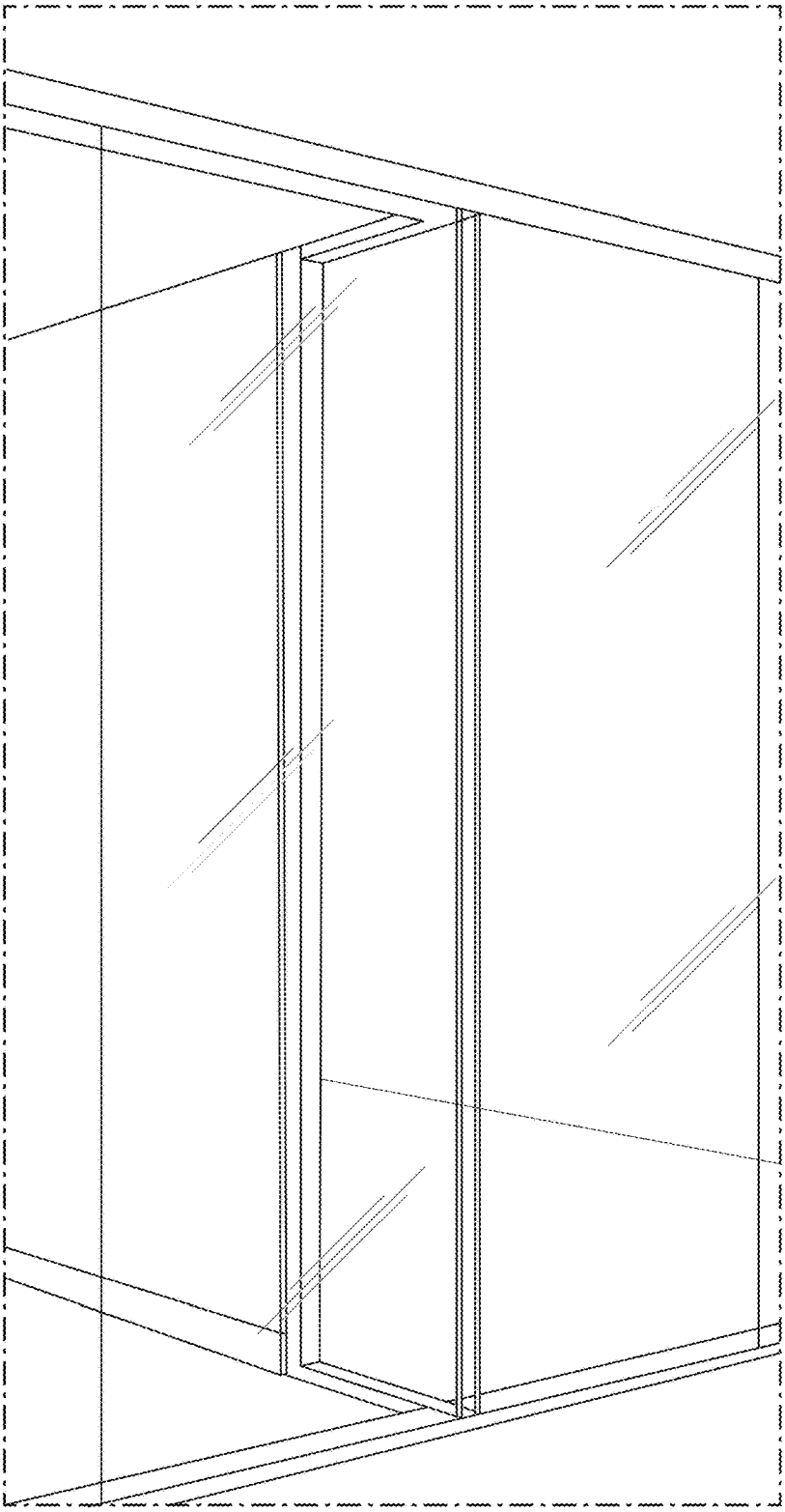
FIG. 1 is a perspective view of a glass partition double butt joint glass T-connection.
Figure 2:
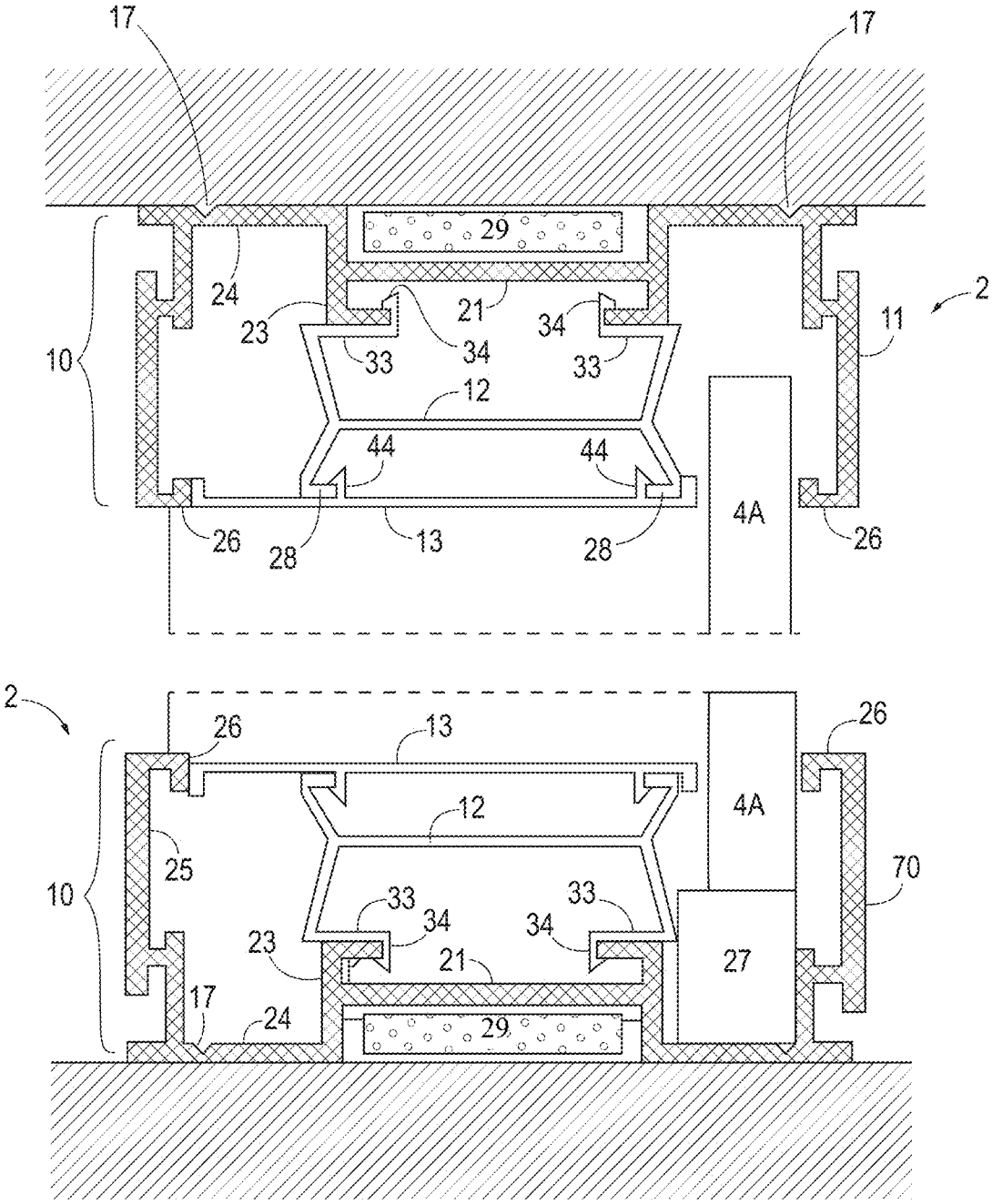
FIG. 2 is an enlarged cross sectional view of both top and bottom framing members 10.
Figure 3:
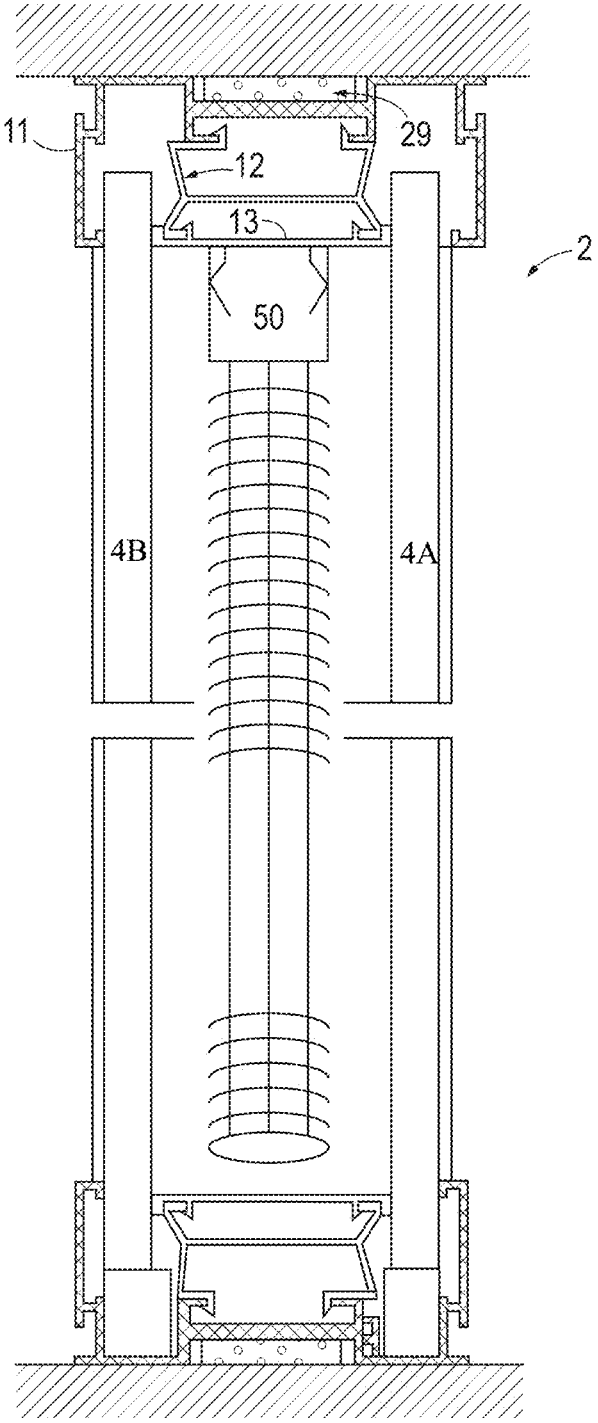
FIG. 3 is a cross sectional view of both top and bottom framing members 10.

With specific reference to FIGS. 2-3, an exemplary embodiment of the system and apparatus of the present invention includes a particular configuration of framing member 10 fabricated in a particular way at the place where a double-butt-joint T-connection is desired.

In practice, both a top main framing member 10 and identical bottom main framing member 10 will be provided, one each at both the lower extremity of a partition wall (typically at the floor) and at the upper extremity of the partition wall (typically at the ceiling). In addition, a top return framing member 10 and identical bottom return framing member 10 will be provided for the double-butt-joint T-connection.

The top framing member 10 may be attached to an overhead portion of the surrounding building structure such as a ceiling, dropped ceiling, bulkhead, joist, beam etc. However, one skilled in the art should understand that the overhead building elements need not be continuous and indeed the partition wall need not be full height. In such case the top framing member 10 may be intermittently attached overhead or minimally attached at both ends to the structure of the surrounding building. The bottom framing member 10 is typically in contact with the floor slab or other floor surface and is preferably mechanically affixed to the floor surface as by screws or the like. However, as with the top framing member 10, the partition wall need not be full height and the bottom framing member may be intermittently attached to a floor surface or other lower structural aspect of the location in which the partition will be installed, such as the top of a half-height wall. The top and bottom framing members 10 are positioned in vertical alignment with one another and trace the horizontal path of the partition wall through and within the space to be divided.

Each glass panel 4A and/or 4B is journaled at top and bottom into a framing member 10. Framing members 10 individually comprise several extruded aluminum interfitting profiles 11-13 each having a particular cross-section, the outermost U-profile 11 being attached to a ceiling or floor as shown in FIG. 2. The framing members 10 may be secured to a supporting structure such as a wall, ceiling or floor by self-tapping screws inserted there through. The framing members 10 each define two vertical cavities into which one or two glass panels 4A, 4B may be seated. In accordance with the invention, pairs of framing members 10 are joined at 90 degree angles to form the double-butt-joint T-connection. The plurality of interfitting profiles 11-13 include U-profile 11, intermediate profile 12, and a cover profile 13. The U-profile 11 is formed as a generally U-shaped cross section open frontally and with a plurality of projecting appendages as will be described. The entire framing member 10 is preferably symmetrically situated about a centerline, and is configured for mounting one glass pane 4A as shown in FIG. 2, or two 4A, 4B as shown in FIG. 3. Each pane of glass 4A, 4B is edge-mounted, a single pane 4A on the front side of the framing member 10 or a double panel 4A, 4B on both sides of the framing member 10 as illustrated (FIG. 3).

The U-profile 11 is defined by a floor having a raised plateau 21 elevated above two opposing recessed pocket sections 24. The plateau 21 may be reinforced by a plurality of longitudinal reinforcing ribs. The two opposing recessed pocket sections 24 are bounded on the outside by raised walls 25. A key aspect of the invention as will be described later is a pair of pre-scored lines 17 defined in the two opposing recessed pocket sections 24 (on either side, inside or outside as a matter of design choice) both running parallel along the entire length of the track 2 in U-profile 11. The pre-scored lines may be formed by extrusion molding as shown near the outer corners, and both provide a fault line for removing frangible portion(s) of the raised walls 25 as will be described. The walls 25 rise substantially flat but each includes converging lips 26 bounding the open-face of U-profile 11. In FIG. 2 a single pane of glass 4A is shown inserted between the junction of the intermediate profile 12, cover profile 13 and wall 25 of U-profile 11 toward the recessed pocket section 24, and in FIG. 3 double panes 4A and 4B are similarly inserted. In either case the track configuration vertically-positions each pane of glass 4A, 4B within the framing member 10.

If desired, a plastic or wood shim/glass support 27 may be provided in troughs 24 of U-profiles 11 to cushion the glass panes 4A, 4B, and this is especially preferred in the bottom-most framing member 10 which endures the weight of the pane(s) 4A, 4B.

The intermediate profile 12 is generally in the shape of an H. The legs (portion facing the bottom of U-profile 11) of each H-shaped intermediate profile 12 contain a picked pin 34 cooperating with edges 23 of the bottom of the U-profile 11 to assure a satisfactory snap-lock fixation. The extremities of the legs of the H-shapes formed by each intermediate profile 12 also each contain a flat zone 33, parallel to the plane of the bottom of the U-profile 11 to assure a satisfying support on edges 23. In a similar way, the arms of the intermediate profile 12 each have a flat edge 28 parallel to the plane of the bottom of the U-profile 11 for support.

The cover profile 13 covers the open face of framing member 10 up to the glass panes 4A and/or 4B. Cover profile 13 snap-locks in place via two picked pins 44 intended to cooperate with the outer arms of the intermediate profile 12. In this way, the assembly of the cover profile 13 in approximate emergence with the extremities of the U-profile 11 is made particularly easy because it comes by the simple fitting of the cover profile 13 to the intermediate profile 12. One skilled in the art should understand that interlocking picked pins are purely examples, and that other snap-fit mechanisms are possible, in particular, inverted pins and edges. If panes 4A, 4B are inserted, the cover profile 13 is dimensioned so as not to cover the totality of the opening of the U-profile 11. The raised plateau 21 of U-profile 11 provides a space between the floor/ceiling surface within which a strip of insulation 29 may be inserted and/or adhered.

Figure 4:
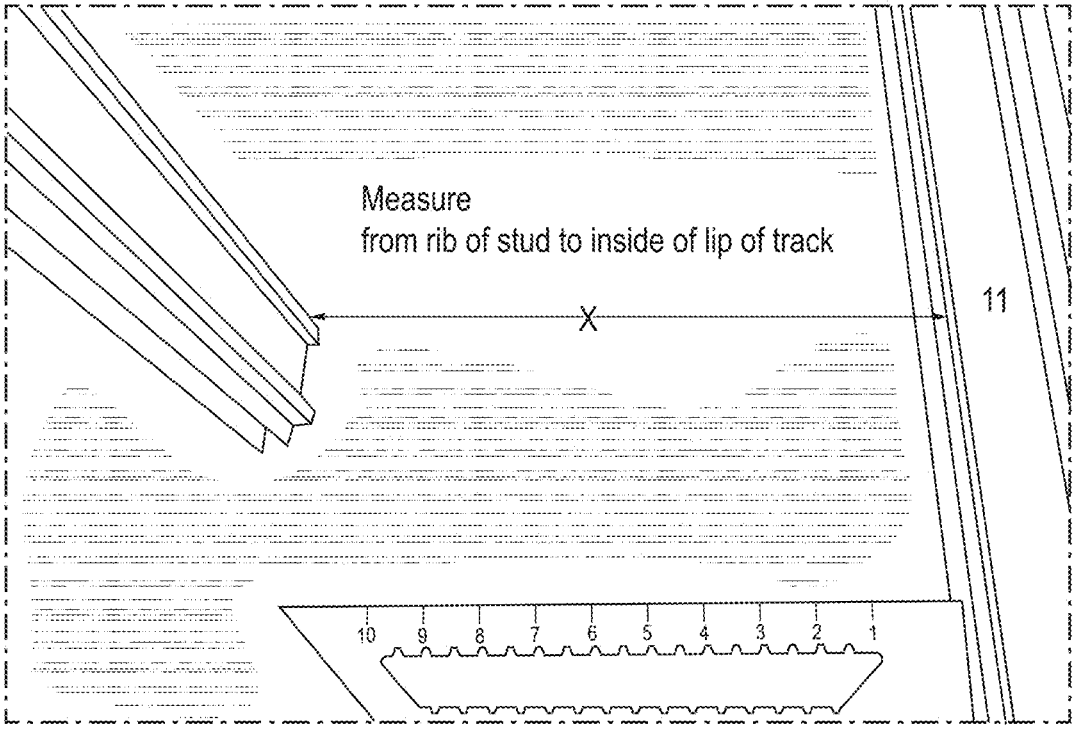
FIGS. 4-11 are perspective assembly drawings illustrating the assembly sequence of the glass partition double butt joint glass T-connection of FIG. 1.

As seen in FIG. 4, installation or assembly according to the present invention starts by cutting the proper length of the lower framing member 10 and separating the profiles 11-13, then taking the lower U-profile 11 and laying it on the floor of the space to be partitioned in front of the vertical stud, along the path of the desired partition, without fastening it to the floor or to the vertical studs. It is suggested to pencil-mark the position on the floor (or use tape), and then obtain a measurement X from the innermost rib of the vertical stud to the inside of the inner lip 26.

Figure 5:
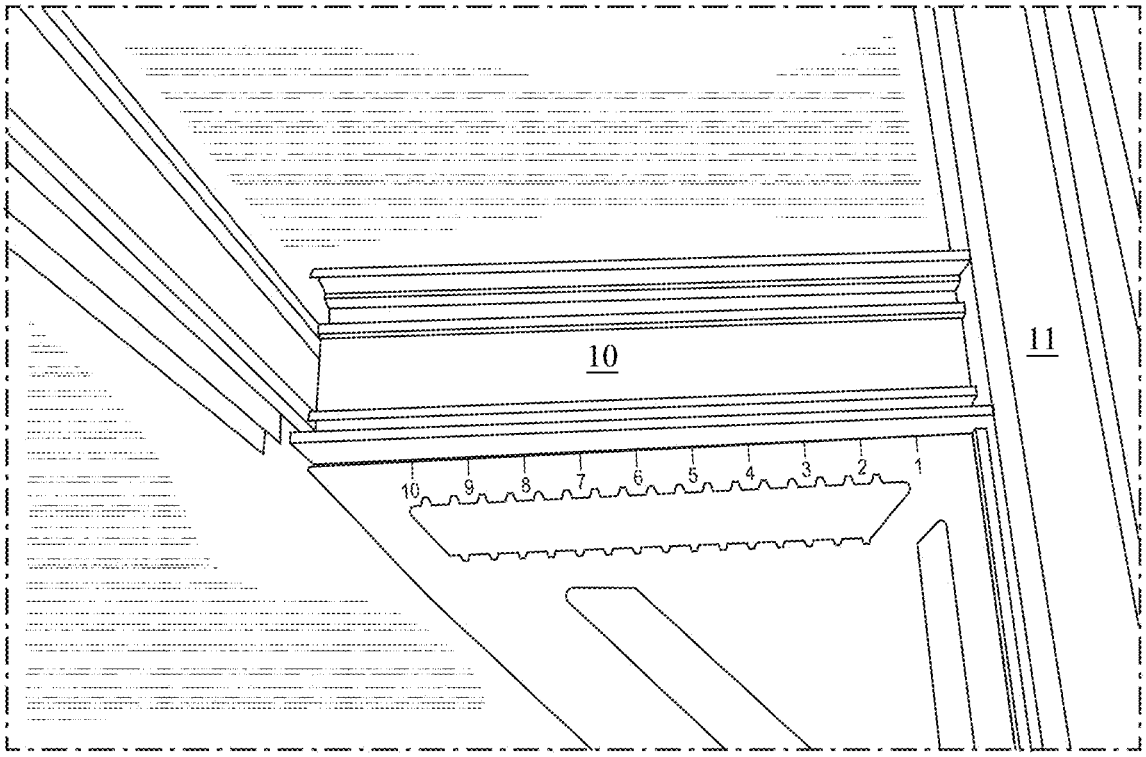

The next in the process of installation or assembly according to the present invention, as seen in FIG. 5, is to cut the proper length X of the return framing member 10 and lay its U-profile 11 on the floor of the space to be partitioned, along the path of the desired partition, at the place where a double-butt-joint T-connection is desired. Again pencil-mark the position on the floor (or use tape). This step will push the main U-profile 11 away a bit, but it should be kept perfectly square by use of a square.

The next step in the process is to use the bottom return U-profile 11 to mark the main U-profile 11 with a sharp pencil and use a square to make full exterior marks along the side of the U-profile (the tracks are sometimes bent a bit, so it is critical to make sure the lines made are squared here).

Figure 6:
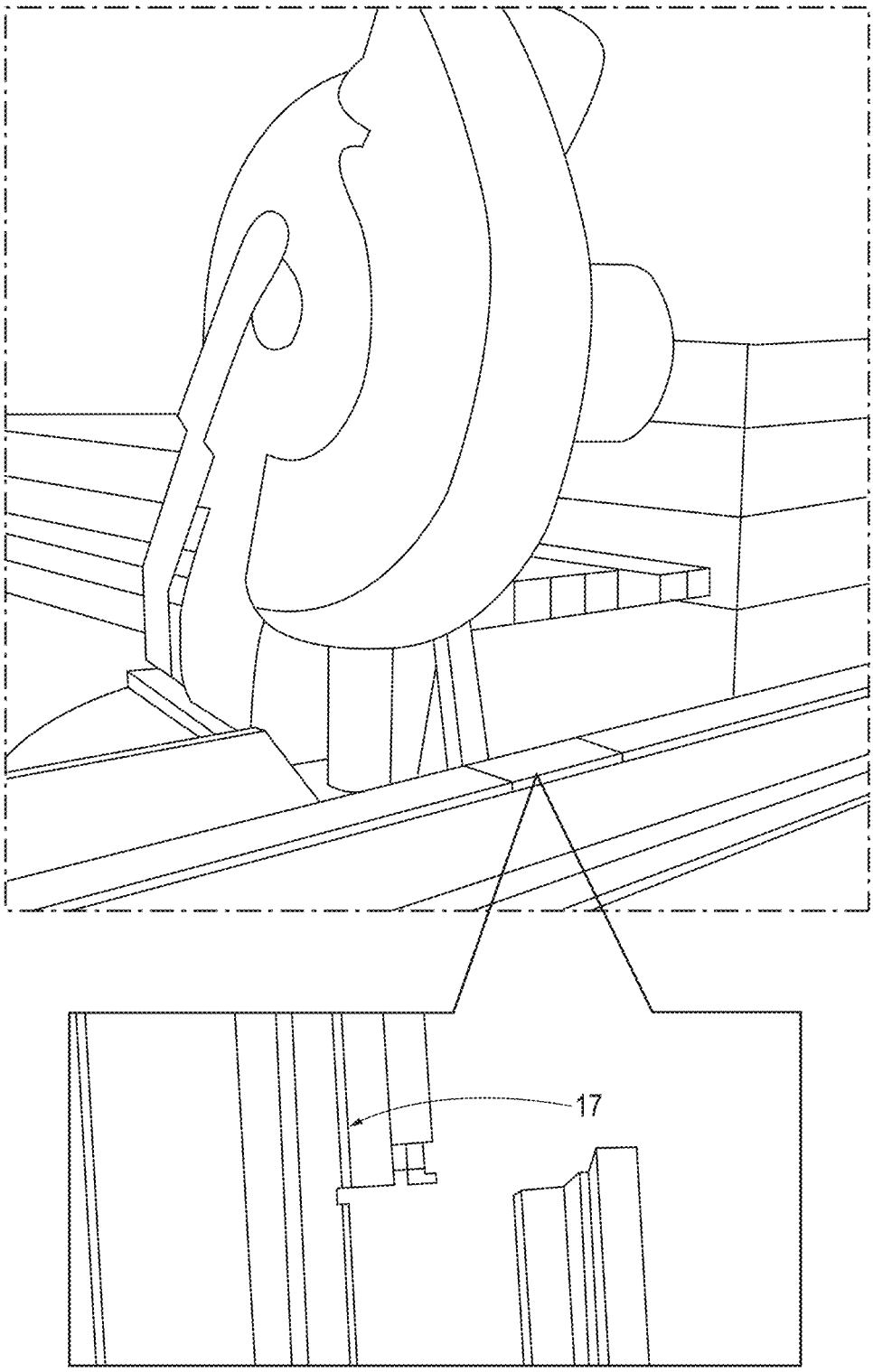

The next step in the process, as seen in FIG. 6, is to cut laterally into the U-profile 11 at the marks as shown and continue cutting through the sidewall, stopping at the pre-scored line 17 in the recessed pocket section 24. Then, as seen in the inset of FIG. 6, the installer may remove the frangible portion of the raised wall 25 simply by bending and breaking off the portion of the U-profile 11 sidewall 25 at the pre-scored line 17.

Next, repeat the preceding step for the upper U-profile 11, using the lower U-profile 11 as a template. Since the top track and bottom track are supposedly perfectly plumbed, the lower U-profile 11 can be used as a ruler to mark the two tracks on the upper U-profile 11, cut, and remove frangible portion of the raised wall 25 by bending and breaking off the portion of the U-profile 11 sidewall 25 at the pre-scored line 17. If desired, the installer can use a laser level to make sure that everything aligns perfectly and shoot or fasten the bottom and top tracks.

Figure 7:
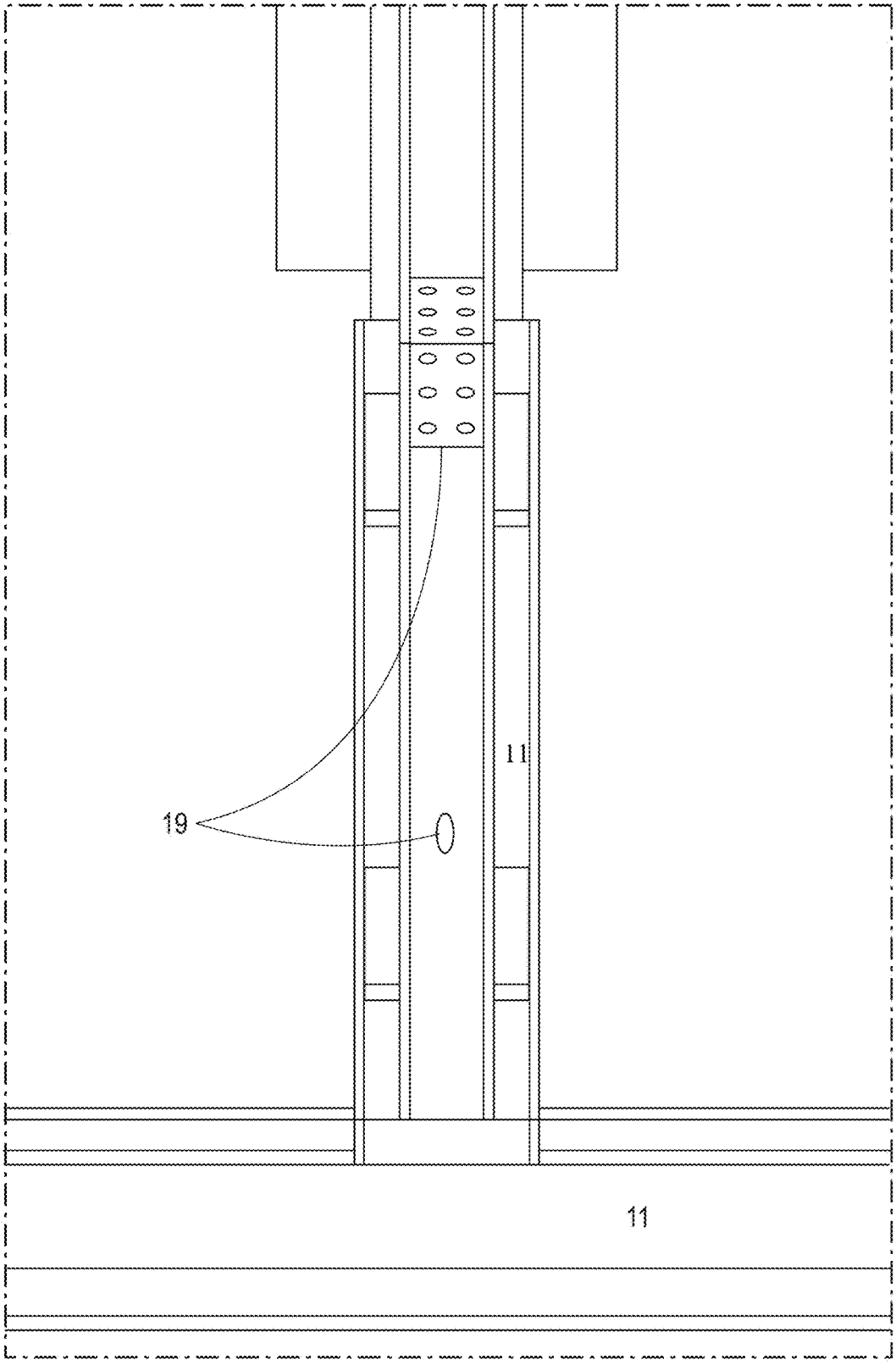

Next, place both lower U-profiles 11 as shown in FIG. 7 at 90 degree angles to form the double-butt-joint T-connection. Insert the intermediate profile 12, and plastic or wood shim/glass supports 27 (if using) in troughs 24 of U-profiles 11 to cushion the glass panes 4A, 4B.

Referring back to FIG. 3, the installer installs the glass in the return first, and one or two return glass panes 4A, 4B may be introduced. Each glass pane 4A is installed by inserting its top edge into the trough 24 of top framing member 10, engaged in the trough 24 (with or without contact with shim 27), then swinging the pane 4A until the bottom edge slides between the U-profile 11 and intermediate profile 12 toward the trough 24 of the bottom framing member 10.

Figure 8:
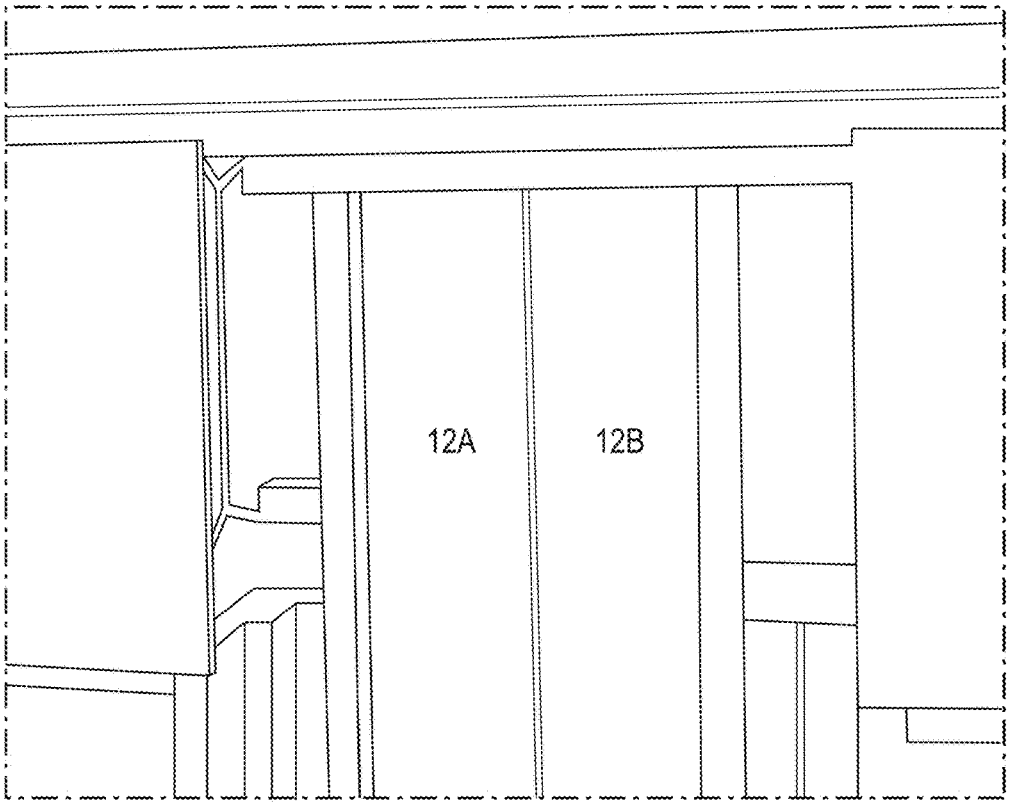
Figure 9:
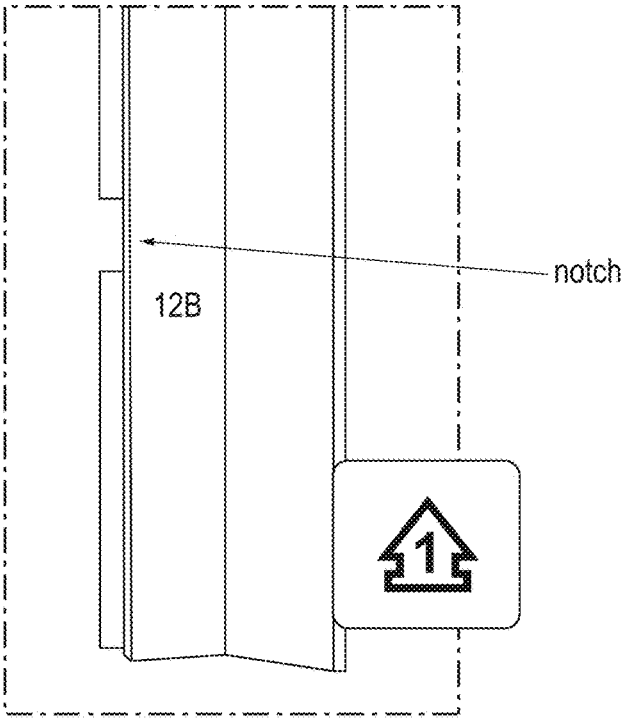

Next, if the front glass partition is a single glass pane (the return wall being double glass) then a pair of return wall wideners 12A, 12B are installed. As seen in FIGS. 8-9 return wall wideners 12A, 12B are cut flush to the second rib of U-profile 11 (FIG. 8) and are notched as shown in FIG. 9 so as to straddle the first rib.

If the front glass partition is a double glass pane (the return wall being double glass) then wall wideners 12A, 12B are unnecessary.

Next, the installer installs the main wall glass pane(s) 4A and/or 4B in the same manner.

Figure 10:
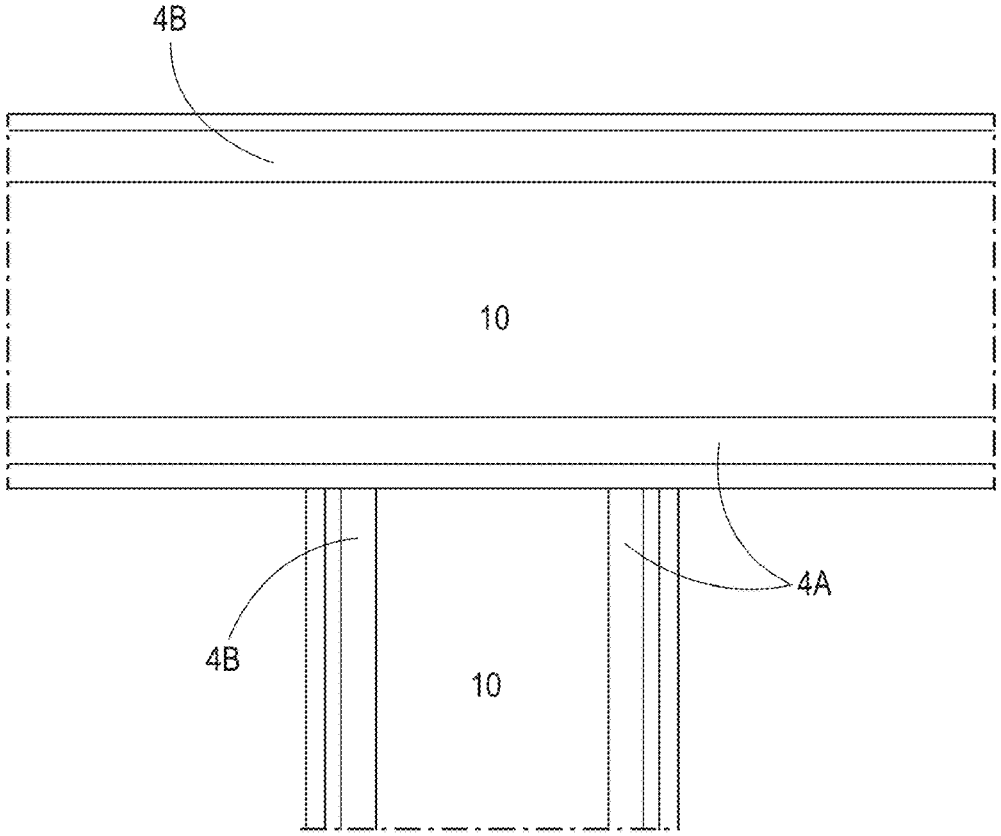

Finally, as seen in FIG. 10 with the intermediate profiles 12 snap-fit in place and positioned/adhered against the angular wall of intermediate profile 12, the upper cover profiles 13 are lastly snap-fit in place. Note that FIG. 10 represents the final configuration where the front glass wall is double glass with panes 4A and 4B.

Figure 11:
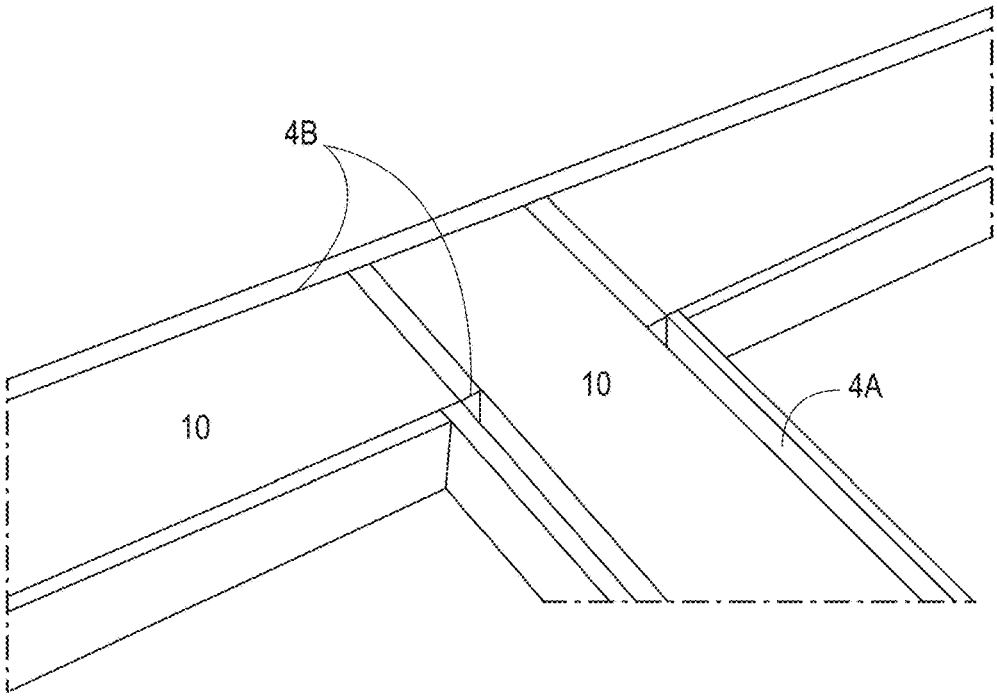

FIG. 11 shows the final configuration where the front glass wall is single glass with pane 4A and, as above, intermediate profiles 12 and upper cover profiles 13 in place. In FIG. 11 a ⅜" gap should be left for the glass, and this is aligned with the adjacent trims.

It should now be apparent that the above-described method and apparatus effectively provides a track system and method of installation thereof capable of constructing a reliable double butt joint glass T-connection easily and quickly. Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A system for installing an interior glass partition in a double-butt-joint glass T-connection, comprising:

an open-topped longitudinal track element having, in cross section:

a horizontal base portion with distal edges and a raised plateau disposed along a midline and elevated above two opposing recessed pocket sections, a longitudinal channel formed atop the raised plateau of said horizontal base portion and centered on said midline, at each distal edge of said horizontal base portion, a longitudinal rail extending upward therefrom, and at least one longitudinal pre-scored frangible line formed in said horizontal base portion, offset from said midline and spanning an entire length of said horizontal base portion;

a longitudinal panel retainer; and a longitudinal cover configured to interlock with said longitudinal panel retainer above said longitudinal panel retainer and abut a converging lip of the longitudinal rail of one of the distal edges of said horizontal base portion, wherein outer edges of said longitudinal channel and each said longitudinal rail collectively form two pocket sections sized to accommodate a pane of glass making up said interior glass partition.

2. The system of claim 1, wherein said system comprises two longitudinal pre-scored frangible lines, each laterally offset from one another across said midline.

3. The system of claim 1, wherein said raised plateau forms a pocket for the insertion of insulating material.

4. The system of claim 1, wherein said longitudinal panel retainer comprises two arms and two legs, each of the two arms connected to one of the two legs, each of the two arms and two legs being joined by a perpendicular cross bar.

5. The system of claim 4, wherein said arms and legs of said longitudinal panel retainer each comprise a snap-lock fixation mechanism at distal ends thereof.

6. The system of claim 1, wherein said longitudinal cover comprises mechanisms for snap-lock fixation with said longitudinal panel retainer.

7. The system of claim 1, wherein said open-topped longitudinal track element, said longitudinal panel retainer and said longitudinal cover are formed from extruded aluminum.

8. The system of claim 1, further comprising one or more glass panels, each of said one or more glass panels sized to seat within one of said two pocket sections.

* * * * *